US005269508A

United States Patent [19]

Hattori

[11] Patent Number: 5,269,508

[45] Date of Patent: Dec. 14, 1993

[54] SHEET SUPPLYING DEVICE FOR IMAGE FORMING APPARATUS

[75] Inventor: Makoto Hattori, Nagoya, Japan

[73] Assignee: Brother Kogyo Kabushiki Kaisha, Aichi, Japan

[21] Appl. No.: 957,810

[22] Filed: Oct. 8, 1992

[30] Foreign Application Priority Data

Oct. 23, 1991 [JP] Japan ..... 3-086530

[51] Int. Cl.[5] ..... B65H 1/00

[52] U.S. Cl. ..... 271/171

[58] Field of Search ..... 271/171, 162, 157, 145; 221/197, 198, 281, 287

[56] References Cited

U.S. PATENT DOCUMENTS 4,535,982 8/1985 Mochimaru ..... 271/157 X
4,763,891 8/1988 Kodama ..... 271/157
5,121,169 6/1992 Kawabata ..... 271/171 X
5,172,903 12/1992 Haneda et al. ..... 271/171

FOREIGN PATENT DOCUMENTS 63-315425 12/1988 Japan ..... 271/171
2-276729 11/1990 Japan ..... 271/171
3-61217 3/1991 Japan ..... 271/157

*Primary Examiner*—David H. Bollinger
*Attorney, Agent, or Firm*—Oliff & Berridge

[57] ABSTRACT

A sheet supplying device in which a stack of sheets are accommodated for feeding each one of the sheets to an image forming apparatus. The device has a casing having a size smaller than a maximum size of the sheets for reducing occupying space of the casing, and sound leakage is avoided by minimizing a gap distance in case of a sheet supplying operation. If A4 size sheets are used, the entire sheets are stored within the sheet supplying device, and a lid member closes an open end portion. Therefore, sound or noise is not leaked to the outside. If A3 size sheets are used, a pull-out segment is pulled out from a side of the sheet supplying device. Part of the sheets are mounted on the pull-out segment and are protruded from the side of the sheet supplying device. In this case, the lid member has a slanting posture. However, a lower portion of the open end portion is closed by the protruded sheets. Any sound directing laterally is shut off by sector plates. Thus, no sound leakage occurs.

3 Claims, 4 Drawing Sheets

SHEET SUPPLYING DEVICE FOR IMAGE FORMING APPARATUS

BACKGROUND OF THE INVENTION

The present invention relates to a sheet supplying device capable of feeding a plurality of kinds of sheets having sizes different from one another for use in an image forming apparatus.

FIG. 5 shows a view for description of a printer assembled with a conventional automatic sheet supplying device. In FIG. 5, within the printer, are provided a printing section 105 having a cylindrical platen 101 and a print head 103, two pairs of feed rollers 107, 109 positioned at upstream and downstream sides of the printing section 105, and a tractor unit 111 for feeding a continuous form sheet. An automatic sheet supplying device 113 is provided for feeding cut sheets to the printer at a front side of the printer, and a stacker 115 is provided at a rear side of the printer for receiving the printed cut sheet.

In the printer shown in FIG. 5, the continuous form sheet is inserted from the front side of the printer and is fed via the printing section 105 by the tractor unit 111, and is discharged from the rear side of the printer. On the other hand, the cut sheet is fed from the automatic sheet feeder 113 into the printer and fed via the printing section 105 by two pairs of the rollers 107, 109, and is discharged onto the stacker 115. Each of the sheet feed passages are shown by broken lines.

In the printer, sound is generated by the actuation of a drive motor which drives the sheet feeding mechanism, by the gear motion and by the printing operation in the printing section. In the automatic sheet feeder 113 shown in FIG. 5, cover members are provided at lateral sides thereof for covering the sheet feed mechanism including a sheet supply roller 117. However, no cover is provided at a top portion of the sheet feeder. Therefore, during a printing operation utilizing either the cut sheet or the continuous form sheet, the generated sound may be propagated in a direction indicated by arrows, so that the sound is leaked out of the printer to render a person uncomfortable.

In order to shield the sound propagation path, a cover member may be provided for surroundingly covering the automatic sheet feeder. However, such a cover must be larger than the largest size sheet which can be fed by the automatic sheet feeder. Therefore, such a cover occupies a larger space, which becomes an obstacle for various works to be conducted around the printer. Further, similar drawbacks may be pointed out in a copying machine and a facsimile machine as well as the printer.

SUMMARY OF THE INVENTION

It is therefore, an object of the present invention to provide a compact sheet feeding device for an image forming apparatus capable of shielding sound generated at the printing section and at a sheet feed mechanism.

This and other objects of the present invention can be attained by providing a sheet supplying device capable of feeding a plurality of kinds of sheets having sizes different from one another for use in an image forming apparatus, the sheet supplying device including a tubular shaped casing, a sheet mounting unit and a cover unit. The tubular shaped casing defines an inner space and has a bottom portion and one side formed with an open end portion through which a stack of a selected kinds of sheets are inserted into the inner space. The sheet mounting unit is disposed on the bottom portion of the casing and is protrudable from the open end portion out of the casing in conformance with the size of the sheet. The cover unit is pivotally supported at a top portion of the open end portion for closing the open end portion. The cover unit has a first pivot position for completely covering the open end portion when a stack of first kind of sheets have sizes smaller than the tubular shaped casing, and has another pivot position defined by a contact between a free end portion of the cover unit with an uppermost sheet of another stack of second kind of sheets when the second kind of sheets have sizes larger than the tubular shaped casing.

In accordance with the present invention, the casing of the sheet supplying device has the tubular shape, whose one end defines an open end portion. At the upper portion of the open end portion, a cover unit is attached for closing the open end portion. If the sheet to be fed has a size smaller than the casing, the lid member can fully close the open end portion so as to shut off a path of sound propagation, the sound being generated within the image forming apparatus. As a result, sound leakage toward the outside is avoidable to eliminate uncomfortable feeling.

The sheet mounting unit is adapted for mounting the sheets, and can be protruded out of the open end portion in conformance with the size of the sheet. Therefore, even if the size of the sheet is greater than that of the casing, such sheet can still be supplied from the sheet supplying device. Further, if the sheet has a size capable of being accommodated within the casing, the sheet supplying device does not largely project out of the image forming apparatus, to thereby provide no hindrance for work conducted around the apparatus.

DETAILED DESCRIPTION OF THE PREFERRED EMBODIMENTS

A sheet supplying device according to one embodiment of the present invention will be described with reference to FIGS. 1 through 4.

Figure 1:
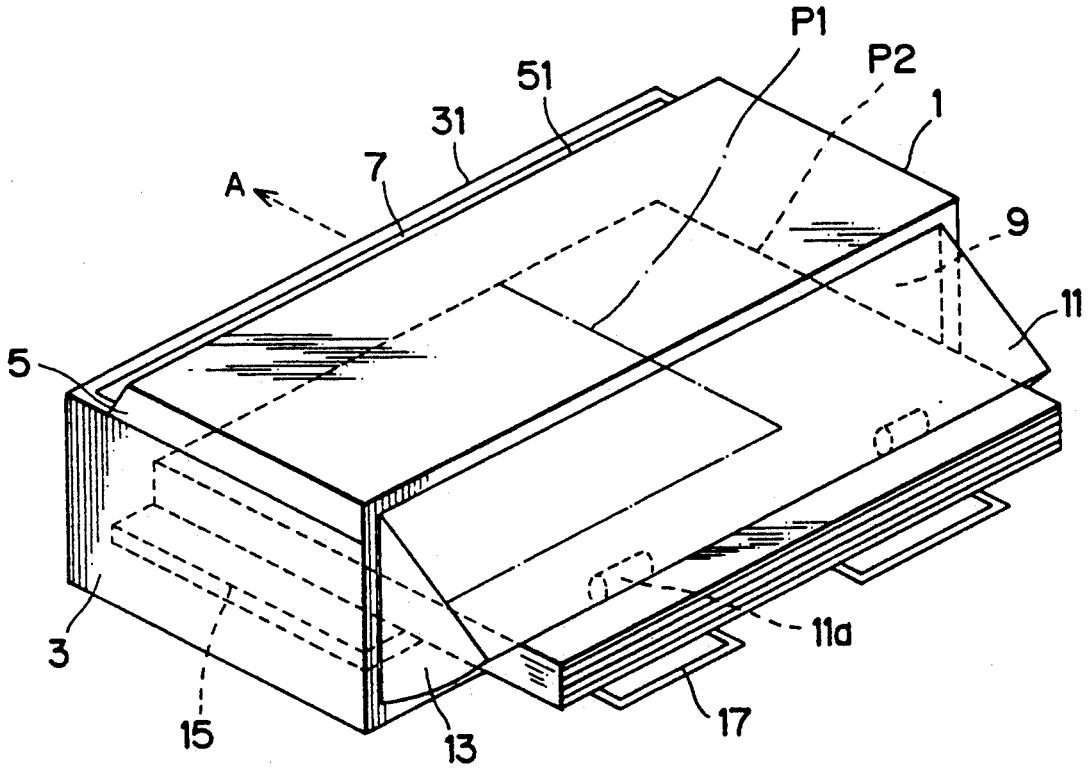
FIG. 1 is a perspective view showing a sheet supplying device according to one embodiment of this invention.

In FIG. 1, a sheet supplying device includes a tubular casing 1 comprising a lower case 3 and an upper case 5 fitted therewith. The lower case 3 has a rectangular boxlike shape while lacking a top wall and one side wall. A sheet discharge slot 7 is defined by a front edge 51 of the upper case 5 and an upper face 31 of the lower case 3, the upper face 31 being in confrontation with the front edge 51. A sheet supplying direction is shown as indicated by an arrow A.

An opening portion 9 is defined at a side opposite the sheet discharge side of the lower case 3. A lid member 11 is pivotally supported to the upper case 5 to close the opening portion 9. At both lateral sides of the lid member 11, sector shaped side members 13 are provided which extend in a direction perpendicular to a longitudinal direction of the lid member 11. The sector shaped side members 13 are accommodatable within the lower case when the lid member 11 closes the opening portion 9, and the side members 13 are gradually moved out of the casing 1 in accordance with the opening motion of the lid member 11. A free end edge portion of the lid member 11, at least one roller 11*a* is rotatably provided. The roller 11*a* is adapted to be in rolling contact with a surface of a sheet P2 described later.

At a bottom portion of the lower case 3, a sheet mounting stand 15 for mounting thereon a stack of cut sheets is provided. A lever 151 is provided at the sheet mounting stand 15, and pins 153 and 155 are provided at the lever 151. The sheet mounting stand 15 is also provided with a pull-out segment 17 on which a sheet portion bulged out of the casing 1 is to be mounted. Pull-out length of the pull-out segment 17 can be controlled in accordance with a size of the sheet.

A size of the casing 1 is selectively determined according to the size of the printer and its function. The sheet supplying device according to the present embodiment is adapted to feed the sheet having up to A3 size. The following description concerns sheet feeding with respect to A4 size sheets and A3 size sheet.

If A4 size sheets P1 shown by a dotted chain line of FIG. 1 are employed, the pull-out segment 17 is retracted in the casing 1, and the lid member 11 is moved to close the open end. The sheets P1 are mounted on the sheet mounting stand 15 with the lid member 11 closed. On the other hand, if A3 size sheets P2 are employed, the lid member 11 is opened, and the pull-out segment 17 is pulled out from the sheet mounting stand 15 by a distance corresponding to a size of the sheet P2. The sheets P2 are mounted on the sheet mounting stand 15 and the pull-out segment 17.

Figure 2:
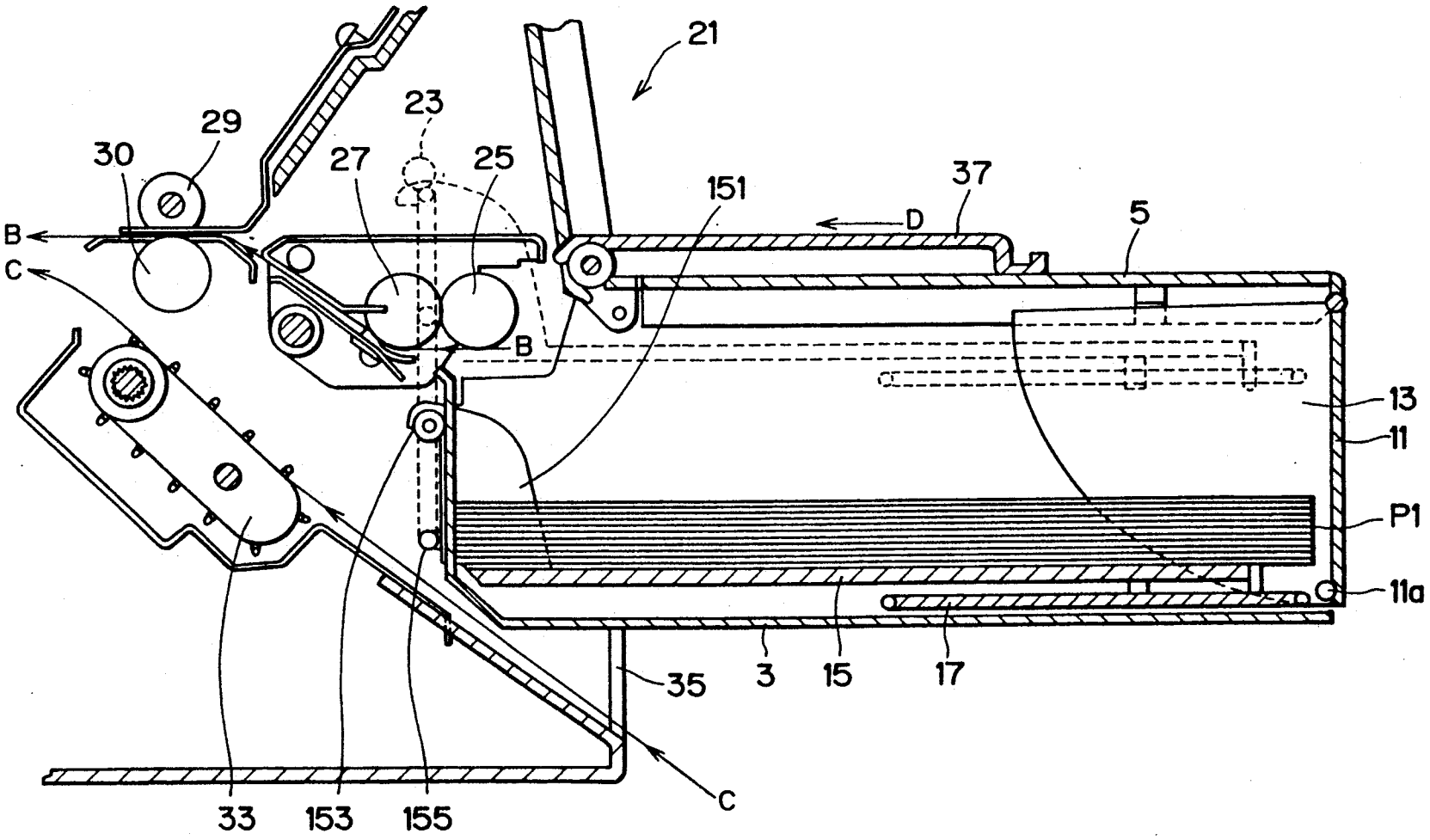
FIG. 2 is a cross-sectional view showing a printer and the sheet supplying device in which A4 size sheets are stored.

FIG. 2 shows a printer and the sheet feeding device storing therein A4 size sheets. The printer 21 is formed with a guide slot 23 for guiding vertical movement of the pins 153 and 155 provided at the lever 151. With this structure, the sheet mounting stand 15 is vertically movable along the guide slot 23 by a moving mechanism not shown.

For printing the sheet supplied from the sheet supplying device, the sheet mounting stand 15 is moved upwardly until the sheet P1 is brought into contact with a supply roller 25 provided at a printer body frame. By the rotation of the supply roller 25, the sheet P1 is discharged out of the casing, and the sheet P1 is then fed toward a print head (not shown) by a roller 27 and feed rollers 29, 30. These rollers 27, 29 and 30 are also provided to the printer body frame. The sheet feed passage is thus provided as shown by an arrow B.

The printer 21 can perform printing on the continuous sheet as well as a manually inserted sheet. To this effect, a tractor 33 is provided in the printer 21 for feeding the continuous sheet. Further, a manual insertion guide plate 37 is provided for manually inserting the sheet. The continuous sheet is inserted into the printer 21 through an insertion slot 35 formed at a front portion of the printer, and is fed to the print head (not shown) along a feed passage C. The manually inserted sheet is inserted in a direction indicated by an arrow D, and is fed to the print head by the feed rollers 29, 30.

If printing is carried out with respect to the sheet P1 supplied from the casing 1 of the sheet supplying device, the lid member 11 has a closed position. Therefore, sound propagation to the outside of the printer can be shielded by the lid member 11.

Further, in case of the printing to the continuous sheet or to the manually inserted sheet, the lid member 11 has the closed position to avoid sound leakage toward the outside of the printer.

Furthermore, if A4 size sheet P1 is employed, the sheets are not protruded out of the casing 1. Therefore, sufficient working space can be provided around the printer 21.

Figure 3:
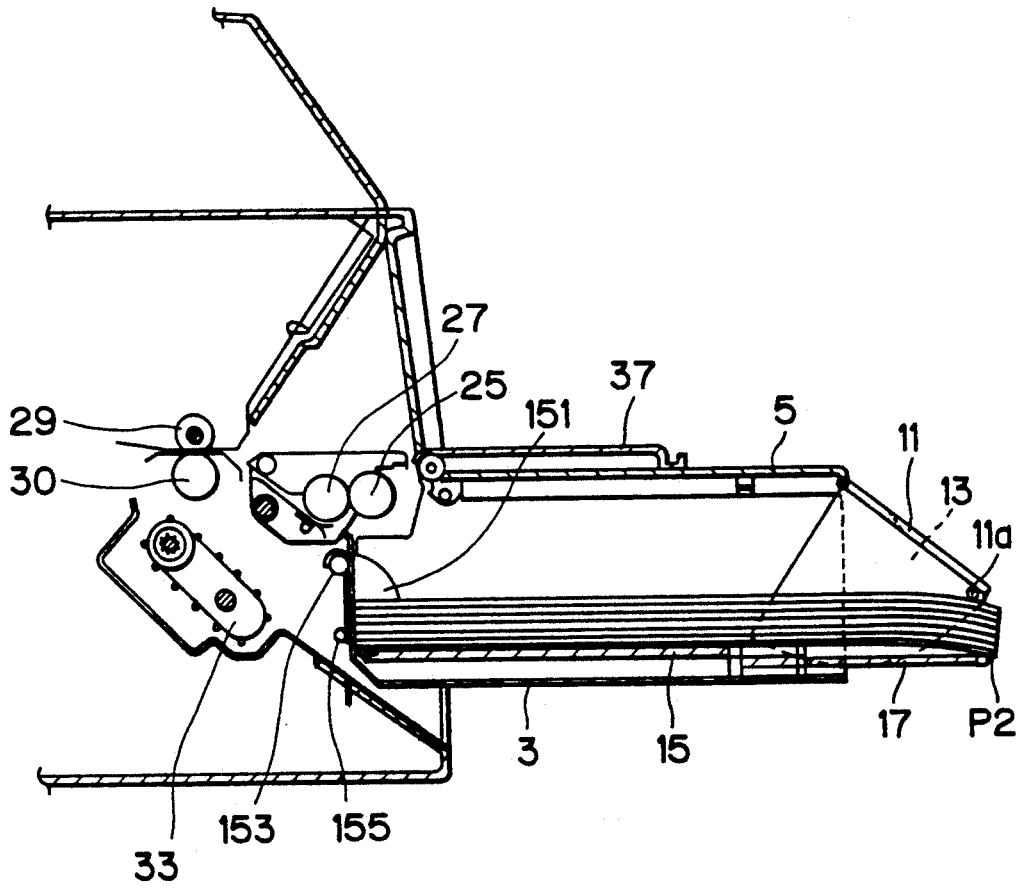
FIG. 3 is a cross-sectional view showing a standby state of the sheet supplying device in which A3 size sheets are stored.
Figure 4:
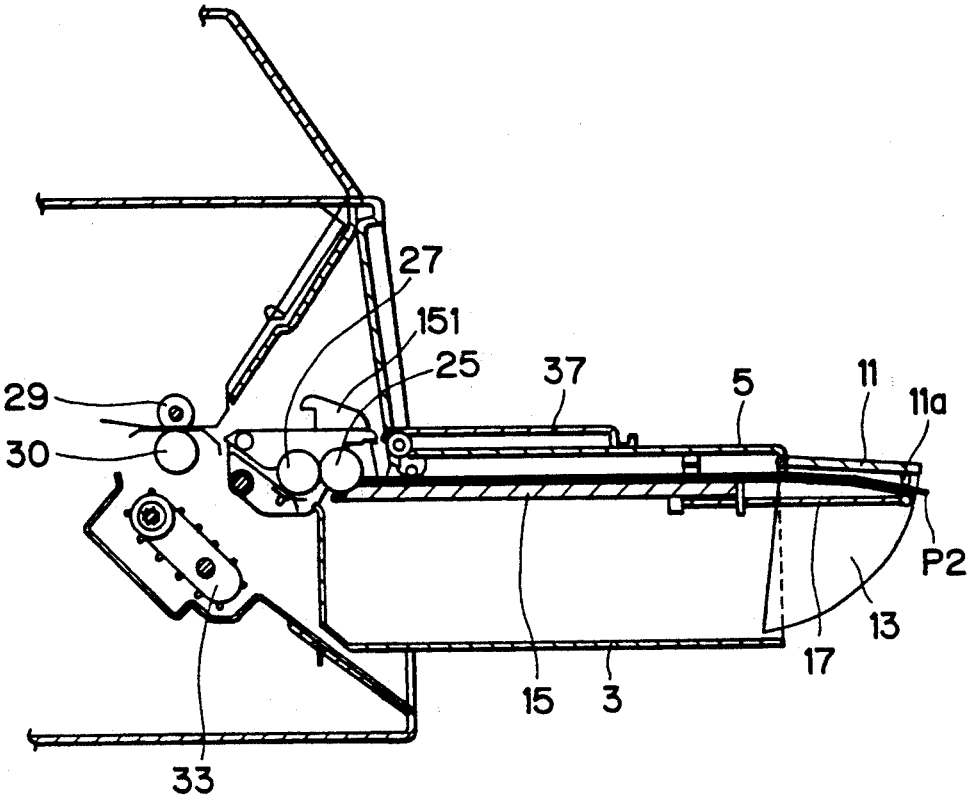
FIG. 4 is a cross-sectional view showing sheet supplying state in the sheet supplying device while using A3 size sheets.
Figure 5:
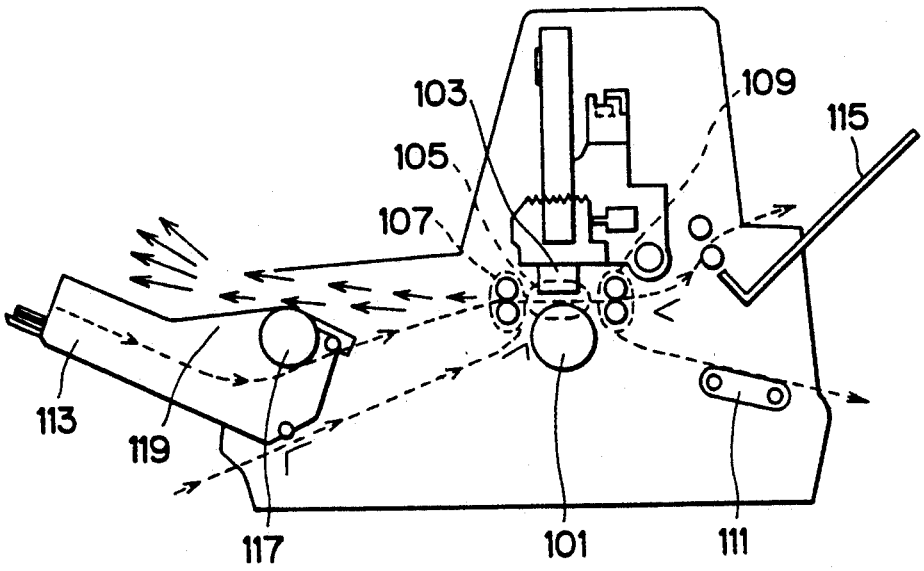
FIG. 5 is a view showing a printer and a conventional automatic sheet supplying device.

FIGS. 3 and 4 show a state when using A3 size sheets P2. A width of the sheet P2 is equal to a distance between lateral side walls of the sheet supplying device (see FIG. 1). As best shown in FIG. 3, if the A3 size sheets are mounted on the sheet mounting stand 15, and the stand 15 has a descent standby position, the lid member 11 has a tilting orientation, and a lower end of the lid member is mounted on the protruded sheet stack. Therefore, the open end of the casing is still closed by the lid member and the protruded part of the sheet stack. The sound directed laterally from the casing is also shielded by the sector plates 13. Thus, if printing is made on the other sheet such as the continuous sheet (not shown), the printing sound is not leaked to the outside of the printer.

With this state, if feeding of the sheet P2 from the sheet supplying device is instructed, the sheet mounting stand 15 is moved upwardly. In this case, the roller 11*a* provided at the tip end of the lid member 11 is in rolling contact with the surface of the sheet P2. Therefore, the lid member 11 is angularly moved without any application of force to the sheet P2. If the uppermost sheet P2 is moved to a sheet feed position, the lid member 11 is directed in an approximately horizontal direction. In this case, a gap whose distance is approximately equal to a diameter of the roller 11*a* is provided between the tip end of the lid member 11 and the sheet P2. However, this gap is small, and sound leakage through the small gap may scarcely occur.

Further, if the roller 11 has an elongated length fully extending between lateral side walls, the sound leakage can be further avoided. Moreover, sound propagation toward the lateral sides of the lid member 11 can be avoided by the sector plates 13.

In the depicted embodiment, no special attention is drawn to a lateral gap between the lateral side edge of the sheet and the lateral side wall of the sheet supplying device, if the sheet has a width smaller than the maximum width of the sheet supplying device. However, such sheets are scarcely used, and therefore, such problem can be neglected. Further, in order to close the gap, a sheet guide (not shown) movable in a lateral direction is provided in accordance with the width of the sheet, and a shielding bellow may be provided between the guide and the lateral wall of the sheet supplying device.

As described above, according to the present embodiment, if A4 size sheets are employed, the sheets do not project out of the casing 1 of the sheet supplying device. Therefore, sufficient working space is obtainable around the printer. This effect is emphasized if the A3 size sheets are scarcely used. If A4 size sheets P1 are used, since the lid member 11 has a completely closed position, sound leakage out of the printer 21 can be restrained at low level, and no uncomfortable feeling is imparted.

Further, if large size sheets such as A3 size sheets are used which are not fully storable in the casing, it is possible to restrain the sound leakage toward the outside by the lid member 11 and the lateral sector plates 13.

While the invention has been described with reference to the specific embodiment, the present invention is not limited to the above described embodiment, but various changes and modifications may be made therein. For example, the sheet supplying device can be applied to a copying machine and a facsimile machine.

What is claimed is:

1. A sheet supplying device capable of feeding a plurality of kinds of sheets having sizes different from one another for use in an image forming apparatus, the sheet supplying device comprising:

a tubular shaped casing defining an inner space and having a bottom portion and one side formed with an open end portion through which a stack of selected kinds of sheets are inserted into the inner space, said open end portion comprising a rear open end, said tubular shaped casing comprising:

a lower case having a box shape and comprising an upper open end and said rear open end, and an upper case positioned at the upper open end, the rear open end having a generally rectangular shape defined by rear edges of the lower case and the upper case;

a sheet mounting unit disposed on the bottom portion of the casing and protrudable from the open end portion out of the casing in conformance with the size of the sheet; and a cover unit pivotally supported at a top portion of the open end portion to a rear end portion of the upper case for closing the open end portion, the cover unit having a first pivot position for completely covering the open end portion when a stack of a first kind of sheets have sizes smaller than the tubular shaped casing, and having another pivot position defined by a contact between a free end portion of the cover unit with an uppermost sheet of another stack of a second kind of sheets when the second kind of sheets have sizes larger than the tubular shaped casing, wherein the sheet mounting unit comprises:

a sheet mounting stand vertically movably provided at a position above the bottom portion, the sheet mounting stand having a size larger than the size of the first kind of sheets for completely mounting thereon the first kind of sheets, and a pull-out segment movably connected to the sheet mounting stand, the pull-out segment being movable to extend from the sheet mounting stand for supporting thereon a part of the second kind of sheets, if the second kind of sheets have a size larger than the sheet mounting stand.

2. The sheet supplying device as claimed in claim 1, wherein the cover unit comprises;

a lid member having an upper major end portion pivotally supported to the upper case, a lower major end portion, and minor side end portions; and a pair of sector plates integrally provided at the minor side end portions, the pair of sector plates extending in a direction perpendicular to a longitudinal direction of the lid member and being retractable into the tubular casing when the lid member has the first pivot position and being protrudable from the tubular casing when the lid member has the other pivot position for preventing sound propagating in the tubular casing from being laterally leaked.

3. The sheet supplying device as claimed in claim 2, wherein the cover unit further comprises a roller member rotatably provided at the lower major end portion of the lid member, the roller member being in rolling contact with the uppermost sheet when the lid member has the other pivot position.

* * * * *